US006178796B1

(12) United States Patent
Hellgren

(10) Patent No.: US 6,178,796 B1
(45) Date of Patent: Jan. 30, 2001

(54) DEVICE AND METHOD FOR SHAPING FLAT ARTICLES

(75) Inventor: Keijo Hellgren, Västerås (SE)

(73) Assignee: Flow Holdings GmbH (SAGL) LLC, Lugano (CH)

( * ) Notice: Under 35 U.S.C. 154(b), the term of this patent shall be extended for 0 days.

(21) Appl. No.: 09/321,844

(22) Filed: May 28, 1999

Related U.S. Application Data

(60) Provisional application No. 60/087,421, filed on Jun. 1, 1998.

(51) Int. Cl.[7] ..... B21D 28/18
(52) U.S. Cl. ..... 72/63; 72/55
(58) Field of Search ..... 72/55, 56, 63, 72/378

(56) References Cited

U.S. PATENT DOCUMENTS

| | | | | |
|---|---|---|---|---|
| 2,344,743 | * | 3/1944 | Smith, Jr. | 72/63 |
| 2,377,664 | * | 6/1945 | Berger | 72/55 |
| 3,566,650 | | 3/1971 | H. G. Johnson | 72/63 |
| 3,611,765 | * | 10/1971 | Harvey | 72/55 |
| 3,614,883 | * | 10/1971 | Kramer | 72/63 |
| 3,672,194 | * | 6/1972 | Martin | 72/55 |
| 3,678,577 | * | 7/1972 | Weglin et al. | 72/55 |

FOREIGN PATENT DOCUMENTS

| | | | | |
|---|---|---|---|---|
| 0 288 705 A2 | | 11/1988 | (EP) . | |
| 333104 | * | 8/1930 | (GB) | 72/63 |

OTHER PUBLICATIONS

Swedish publication Verkstäderna nr 8, entitled "A Giant Among Presses, "dated Aug. 12, 1991, 2 pages.

* cited by examiner

*Primary Examiner*—David Jones
(74) *Attorney, Agent, or Firm*—Seed I. P. Law Group PLLC

(57) ABSTRACT

A device and a method for shaping a flat article under high pressure, in which a one-sided forming tool is used together with a high pressure press equipped with a membrane. The one-sided forming tool comprises at least one first trimming device, a second trimming device provided with a punch, and with at least two clamps arranged to hold a blank in position over said one-sided forming tool. The clamps are arranged moveable in respect to each other such that the blank is stretchable and pressure is applicable by said membrane so shaping the blank against said one-sided forming tool within a single and continuous press operation. The one-sided forming tool also comprises a piercing device. The advantage of the invention is that an article may be stretched, trimmed, shaped and pierced in one continuous forming cycle, which article may also be formed from a blank that has been pre-painted on at least one side.

15 Claims, 4 Drawing Sheets

DEVICE AND METHOD FOR SHAPING FLAT ARTICLES

This application claims the benefit of U.S. provisional application Ser. No. 60/087,421, filed Jun. 1, 1998.

TECHNICAL FIELD

The invention relates to a device and a method for shaping flat articles from sheet metal. More specifically the invention concerns shaping flat articles from sheet metal in the automobile industry.

BACKGROUND ART

In a process for forming large, substantially flat articles in an industry such as the automobile industry it is common to use large conventional presses to stamp or press body panels such as roofs, hoods and trunk lids from sheet metal.

Such a stamping or pressing process usually involves a press with a three piece tool which has two large shaping surfaces, typically two halves of a mould made of highly expensive tool steel. There is also a third device to hold a sheet of metal, which is subsequently shaped by the two mould halves.

Depending on the degree of deformation involved, there may be more than one stamping or pressing stage needed to achieve the required shape and profile. However a conventional press is limited to achieving a maximum of between 1%–2% stretching during the shaping of substantially flat articles.

Membrane presses have been used extensively for the forming of articles from sheet and U.S. Pat. No. 2,344,743 and U.S. Pat. No. 3,614,883 describe membrane presses in which a blank sheet of metal is formed against a single forming surface. It is further described that the edges of a blank may be trimmed during a press cycle by being forced into a recess. However, the degree of deformation available with the devices of U.S. Pat. No. 2,344,743, U.S. Pat. No. 3,614,883 is limited to what may be achieved in localized parts of the forming surface by the fixed contours of the forming surface. U.S. Pat. No. 3,566,650 describes a membrane press in which a tool or plunger may be incorporated in a forming tool to shape or deform a blank in one place during a press cycle. U.S. Pat. No. 3,672,194 describes a membrane press in which the edges of a blank may be trimmed or perforated during a single pressure cycle.

EP 0 288 705 A2 describes a membrane press in which a metal blank may be formed against a one sided forming tool. Additionally the tool comprises moving parts which are moveable during a press cycle that includes increasing pressure through various phases. During a cycle edge cutting may be followed by drawing material into recesses of the mould tool, and intermediate cutting may be then carried out by further deep drawing into undercuts, before a finishing pressure is attained. EP 0 288 705 A2 describes how local shaping may be carried out in a continuous operation.

An article entitled "A Giant among Presses" in a Swedish publication Verkstäderna nr 8 dated Aug. 12, 1991 describes a Swedish membrane press of the Quintus type and a forming tool used by an automobile manufacturer. The use of a membrane press for short run production of articles is discussed in the article and it is stated that an integration of trimming edges in a forming tool is especially advantageous in short run production.

However neither EP 0 288 705 A2 nor any of the above references describe how extensive and uniform plastic deformation of a blank may be achieved, extensive deformation greater for example than 1%–2% stretching during the shaping of substantially flat articles, nor a device for achieving such a deformation, and neither is it described how such extensive plastic deformation may be combined with other processes in a single press operation.

In conventional processes, additional shaping stages may be required to cause sufficient plastic deformation to result in work hardening in the sheet metal and thereby achieve a particular strength in the metal. Additional stages are usually required for trimming surplus material. After pressing and trimming the edges the shaped article is ready for surface treatment as part of a painting process.

The conventional stamping or pressing process needs further improvement. In particular to produce high strength, low weight, substantially flat articles from sheet metal without additional shaping stages. It would also be preferable for a stamping or pressing process to be able to handle ready treated or even ready decorated sheet metal. In addition, it would be beneficial if the cost of the tooling for such a shaping process could be reduced so that substantially flat metal articles may be produced in low volume production runs to supply niche or specialised markets.

SUMMARY OF THE INVENTION

The object of the invention is to provide a device and a method for the shaping of substantially flat articles that achieves a finished shape in one single press operation. It is a further object of the invention to make it possible to achieve a high strength substantially flat article in a single press operation method by causing a controlled and evenly distributed degree of work hardening in the substantially flat article. It is a still further object of the invention to shape substantially flat articles from sheet metal that is pre-treated or pre-painted.

These objects are achieved by the invention as described below. One advantage of the invention is that in one and the same continuous press operation it is possible to stretch, trim and shape-to-final-form a finished, surface-treated metal article as an end product. The invention is more useful than existing processes for shaping articles from sheet metal as it is applicable to a wider range of products. The invention is additionally characterised in that it is economical to produce substantially flat articles made of sheet metal in low volume production runs.

There is a requirement in the automobile industry, for example, to lower the finished weight of automobiles in order to improve fuel economy. Automobile outer body panels made from a material with high strength are required so that the weight of the outer body panel may be reduced, compared to a weaker material, while still producing a panel with sufficient strength for its function.

Examples of substantially flat articles within the automobile industry that are particularly suitable for the method and device according to the present invention are roofs, hoods or bonnets, fenders, wings, trunk lids or boot lids.

The invention comprises a method in which a metal sheet, hereafter described as a blank, is placed in a high pressure press and shaped into a substantially flat article. The blank is held by clamps which stretch the blank to a predetermined degree which may be significantly greater than 2%. After stretching, pressure is applied to the blank. The high pressure press used in the invention is of the membrane type, for example a Quintus press, and the pressure is applied to the blank via a rubber membrane. The blank is pressed against a forming tool and is shaped into the form of a substantially flat finished article. The method and device requires only a single sided forming tool. The function of another half of a conventional forming tool is effectively carried out by the membrane.

An advantage of this invention compared with other processes currently separately available include that the stretching of the metal sheet along an axis to the desired tension level creates plastic deformation, thereby using the material in an optimum way with respect to the work hardening.

Another advantage of the present invention is the use of a rubber membrane against the outer surface of the metal sheet which makes it possible to shape a pre-painted metal sheet.

A further advantage of the present invention is that the pre-painted metal sheet is trimmed in a time during which the process passes from a stretching phase to a flanging phase without the process being interrupted. What is new about the process is to be able to simultaneously carry out in one continuous process actions some of which were only known previously as separate methods and/or devices.

A further advantage of the present invention is that it may be used to produce a wider range of substantially flat articles formed from sheet metal because the method is economic for more articles and applications, including prototypes and other one-of-a-kind products. In addition, the use of a single sided forming tool substantially decreases the tool manufacturing cost and process development time required.

BRIEF DESCRIPTION OF THE DRAWINGS

The presentation will be described in more detail in connection with the enclosed drawings.

DESCRIPTION OF THE PREFERRED EMBODIMENTS

A method for shaping sheet metal to produce substantially flat articles, for example an automobile roof according to the invention is carried out by means of a shaping device in the following way.

Figure 1:
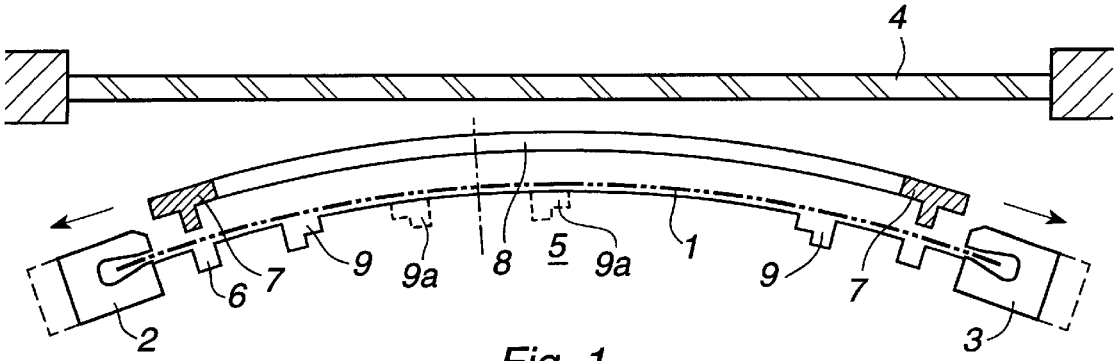
FIG. 1 shows schematically a device and method according to the invention.
Figure 2:
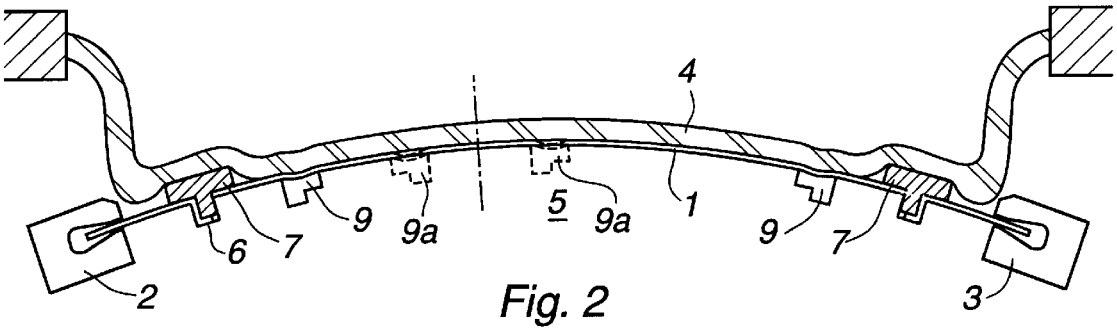
FIG. 2 shows a device and a first trimming stage according to the invention.

A metal sheet hereafter referred to as a blank 1 is placed in a high pressure press with a membrane, held, for example, by a first clamp 2 and a second clamp 3 as shown in FIG. 1. The blank 1 is arranged with one surface facing the membrane 4. The surface may be pre-coated with a surface treatment. The first clamp 2 and the second clamp 3 are arranged moveable in relation to each other so that they may be moved apart from each other and stretch the blank 1. Blank 1 is stretched by clamps 2, 3. When a predetermined part of the required degree of stretch has been attained, pressure is applied to the membrane 4 of the high pressure press as shown in FIG. 2 and the pressure is continually increased over time, as indicated in the graph in FIG. 5. The membrane 4 presses the blank 1 against a forming tool 5.

Figure 3:
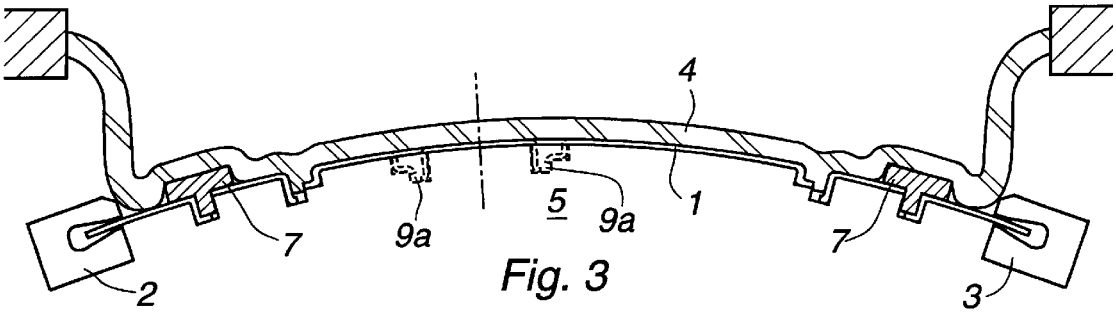
FIG. 3 shows a device and a second trimming stage and a shaped article according to the invention.

Under low pressure the areas at the edges of the blank 1 are forced against a first trimming device 6, shown in cross section as a recess machined in the surface of the forming tool 5 in FIGS. 1–3. More exactly, the blank 1 is forced against the trimming device 6 by a T-shaped punch 7 held in place above the recess of the first trimming device 6 by a frame 8. A first rough trimming stage, see reference no. 14 of FIG. 5, takes place in which the inner area of the blank 1 is separated from the outer edges of the blank 1 held by the clamps 2, 3. During the rough trimming stage 14, the punch 7 is forced down by membrane 4 against blank 1, forcing it into the first trimming device 6, thus trimming the outer edges of blank 1.

Figure 4:
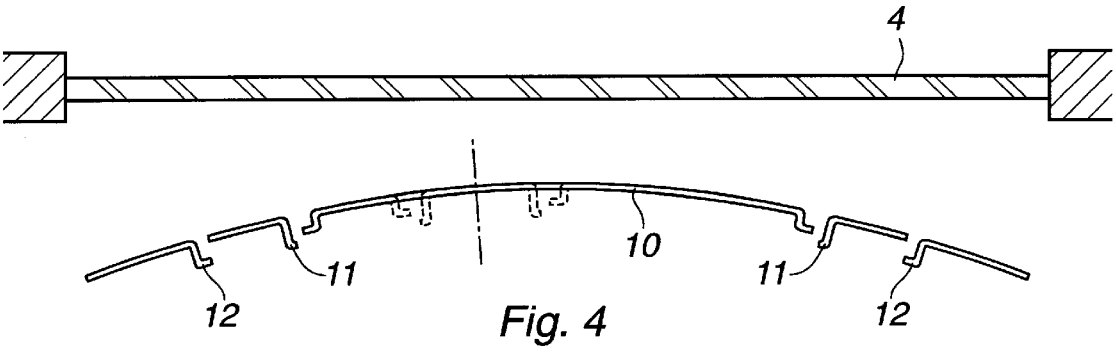
FIG. 4 shows a finished article and trimmed scrap at the end of a shaping process.
Figure 5:
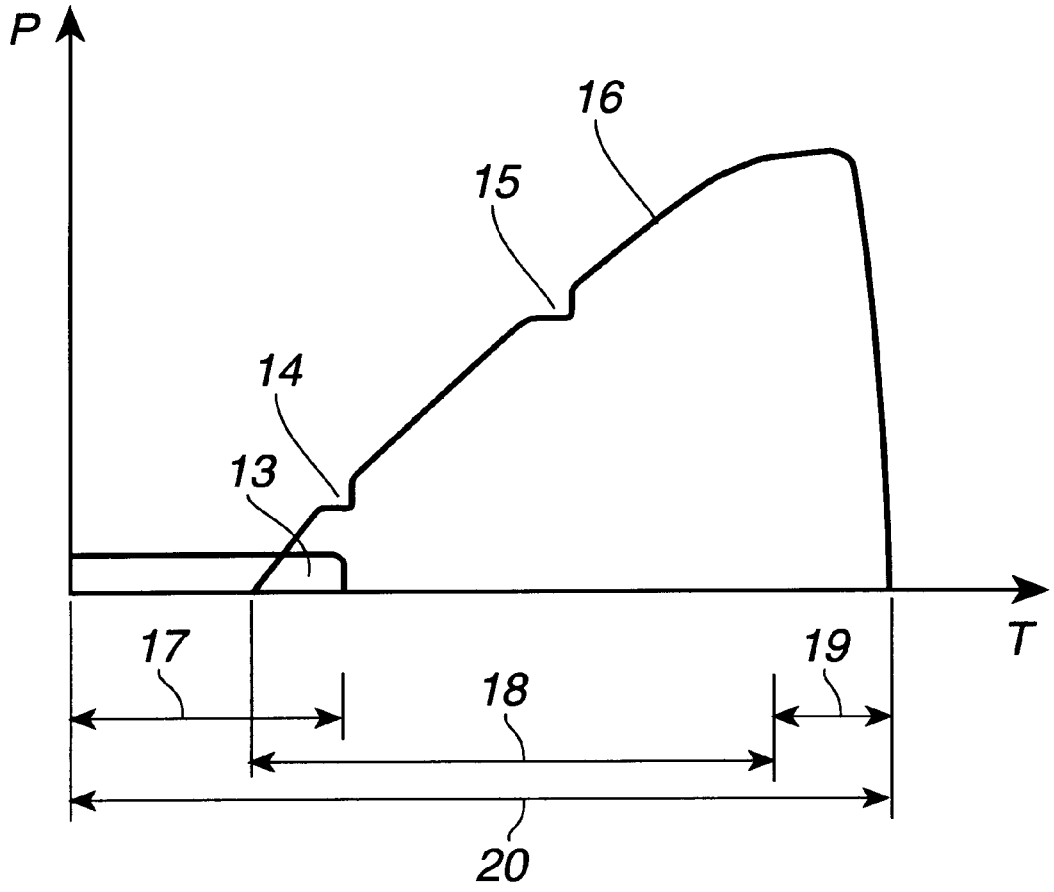
FIG. 5 Shows a schematic graph of pressure (P) exerted against time (T) during a shaping process according to the invention.

Pressure is continuously increased, as seen in FIG. 5, and a second trimming stage, see reference no. 15, a fine trim, takes place inside a second trimming device 9, a step-shaped recess, at a higher pressure. The second trimming stage 15 trims the edges of blank 1 to the required final shape. Pressure is continuously increased to a maximum pressure which shapes blank 1 into, for example, the shape of an automobile roof, according to the detailed surface and contour of the forming tool 5. After the required process time at high pressure has elapsed the pressure is released. The fully shaped and trimmed article 10, for example an automobile roof, is then removed from the press as well as a first trimming scrap 12 and a second trimming scrap 11 as depicted in FIG. 4.

The phases of the process are shown in the pressure, P versus time, T graph of FIG. 5. In the graph the continuous transition from stretching to rough trimming 14 is indicated by the line reference no. 3 on the graph. The notches 14 and 15 in the pressure/time line show the first rough trimming and second fine trimming stages. Build-up of pressure to the maximum pressure of the method is indicated by 16. The beginning of the stretching phase is indicated by 17 and the time interval in which pressure is applied by membrane 4 is indicated by the line 18. Flanging takes place continuously between stage 14 and the point of maximum pressure 16. Removal of pressure is indicated by the line 19 and the total shaping sequence is indicated as 20.

A further development of the first and second trimming devices 6, 9, which are shown in the Figures as recesses, may be incorporated in the surface of the forming tool 5 shaped as a third recess. Such a third recess defines the shape of an enclosed area of material to be separated from the rest of the blank 1, so creating an opening in a finished article. The development of the trimming device 6 and 9, such as a third recess, is referred to hereafter as a piercing device (9*a*). In the example of an automobile roof, a suitably shaped piercing device (9*a*) creates an opening for a sun-roof, for example. Within a panel for the rear fender of an automobile, an opening for a fuel door is created in a single shaping process. Similarly finished openings in door panels to receive door handle and/or lock assemblies, and finished openings in wing or fender panels for light or signal assemblies are formed in one single and continuous high pressure shaping operation.

The trimming devices 6, 9 are shown in the FIGS. 1–4 and FIGS. 6–8 as recesses. Trimming devices according to the invention may alternatively include one or more raised and relatively sharp edges against which the blank 1 is trimmed by application of pressure by the membrane. Similarly, a trimming device and/or piercing device within the spirit of the invention may comprise one or more sharp-edged parts of the forming tool that are moved out from the surface of the mould during the method for shaping flat articles by mechanical or hydraulic means to carry out a trimming or piercing action.

Figure 6:
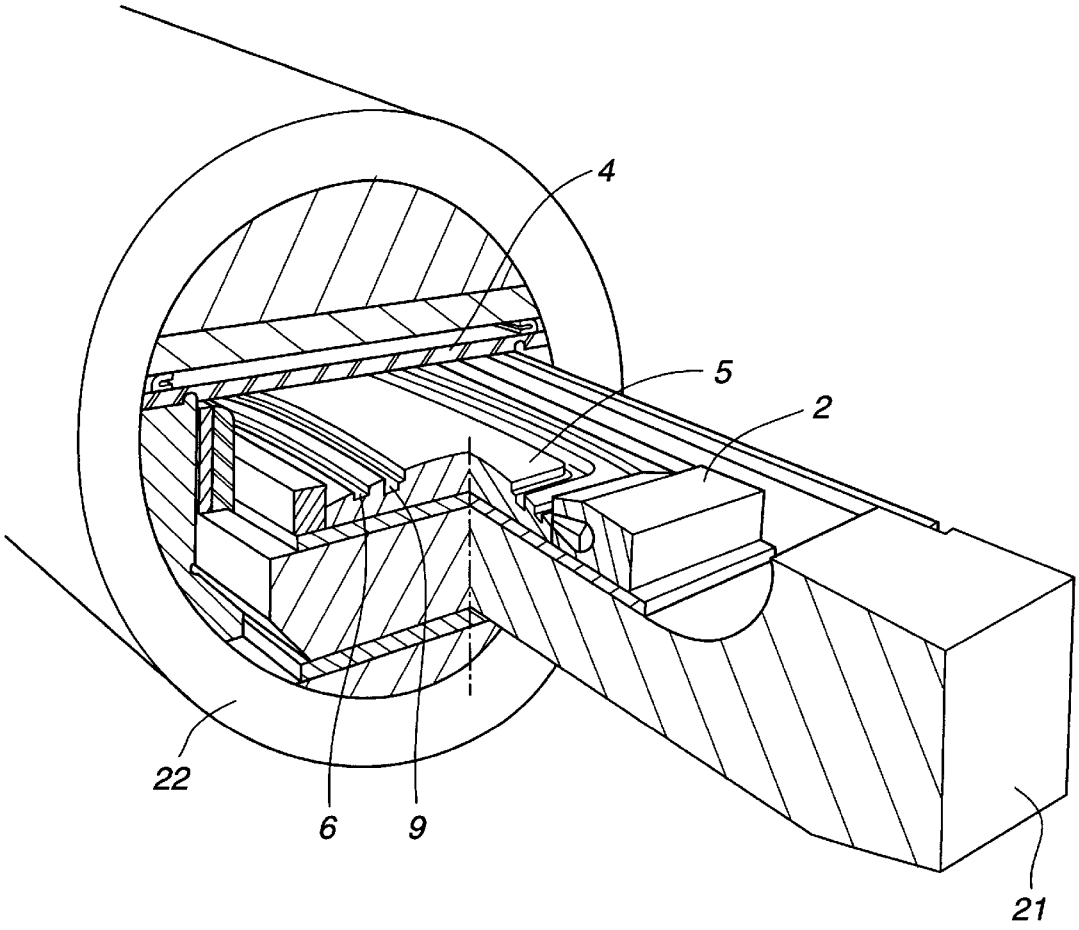
FIG. 6 shows schematically an isometric and sectional view of a high pressure press arranged according to the invention for the shaping of substantially flat articles.

A device for the shaping of articles comprises a high pressure membrane press, for example of a Quintus type, see reference no. 22 in FIG. 6. In FIG. 6 is also shown the forming tool 5 in a press bed 21 of the Quintus press 22. The forming tool 5 is shaped in the finished contour of the required article, and it comprises at least two trimming devices 6, 9 shown here as recesses machined into the surface of the forming tool 5. The first trimming device 6 is used in combination with a punch 7 held in place over the recess of the first trimming device 6 by a frame 8 shown in FIG. 2. The punch 7 is shaped so as to intensify the pressure on the material of blank 1 that lies over the recess of the trimming device 6. The punch 7 as shown in FIGS. 1–3 has, for example, a T-shaped cross section. The forming tool 5 is also referred to as a one-sided forming tool because, unlike the conventional practice of forming a metal sheet into a flat article between two halves of a shaped moulding tool, it consists of one shaped side and it is the membrane 4 that shapes the metal blank 1 against the forming tool 5.

Figure 7:
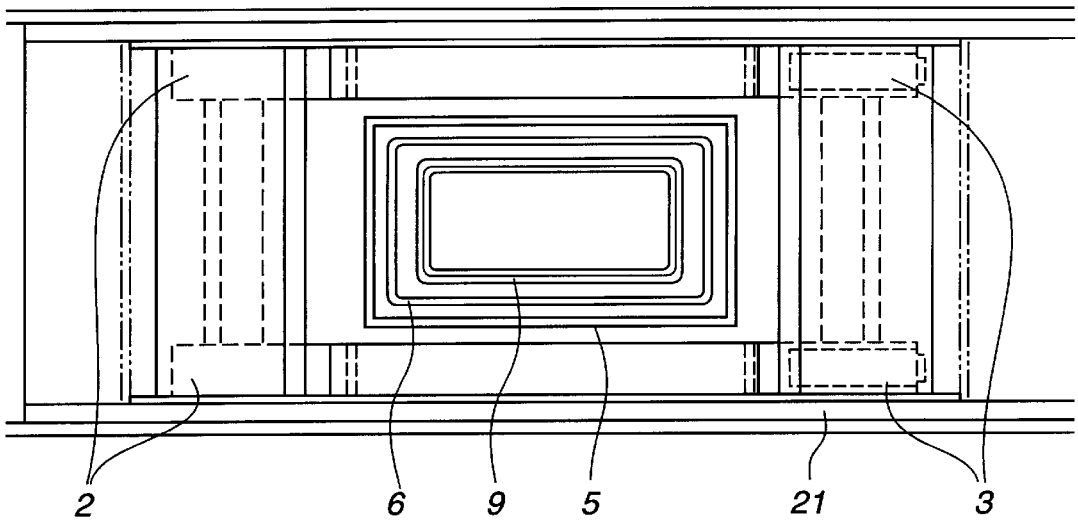
FIG. 7 shows a view from above of a one-sided shaping tool for shaping substantially flat articles according to the invention.
Figure 8:
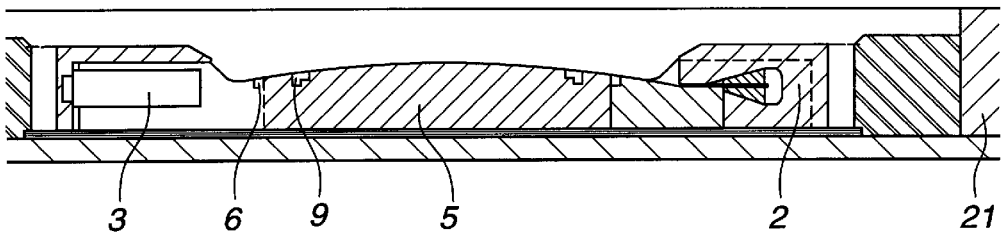
FIG. 8 shows a view from the side of a one-sided shaping tool for shaping substantially flat articles according to the invention.

FIG. 7 shows another view of the forming tool 5 in cross section showing the relative positions of the clamps 2, 3 and the trimming devices 6, 9 arranged in the press bed 21.

The pressure to move the moving clamps 2, 3 may be provided by internal mechanical or hydraulic pressure from the high pressure press. Alternatively, the moving clamps may be moved by external hydraulic or mechanical power sources.

The sheet metal that blank 1 is made from is preferably manufactured with a microstructure that produces desired and high strength properties under sufficient plastic deformation. The sheet metal is produced and arranged in the high pressure press as blank 1 such that the microstructure of the sheet is optimally positioned in relation to an axis of stretching to deform and work harden during the stretching phase and the shaping operation. It is within the spirit of the invention that blank 1 may be held by more than two clamps and stretched in more than one axis.

A metal sheet with a pre-treated surface may be shaped into a substantially flat article by the invention. The pre-treatment may include final finishing substances such as a paint finish and may alternatively comprise other functional surface treatments such as pre-painting treatments and anti-corrosion treatments as well as decorative automobile finishes.

The best use of the invention is as follows. At the beginning of a production run, a pre-treated metal sheet is placed in the open press as blank 1 positioned between clamps 2, 3 above the forming tool 5.

The forming tool 5 comprises final contours of the required shape of the substantially flat article, the trimming device 6 that defines an outer periphery of blank 1, the trimming device 9 that defines in blank 1 a periphery of a finished substantially flat article 10, and a development of the trimming devices 6 and 9, a piercing device (9*a*), such as a third recess shaped such that an opening is made in the finished article 10.

The shaping method is as described above and as shown schematically in FIG. 5 and comprises the following steps. The high pressure press closes and the blank 1 is initially stretched by clamps 2, 3 moving apart from each other. Pressure is gradually applied to the membrane 4 after the required degree of stretching has taken place. This is, for example, an extension of between 1% and 7% and preferably between 1% and 4% for a type of aluminium suitable for an automobile roof, for example. The upper limit of this stretching is considerably higher than 7%. According to the invention the practical limit is in fact the breaking point of the material in question, which may be as high as 35% for a type of steel.

Pressure is gradually increased and the blank 1 is forced against the forming tool 5 by the pressure applied by the membrane 4. During the beginning of the pressure build-up, the edge areas of the blank 1 situated immediately over the first trimming device 6 adjacent to the clamps 2, 3 are trimmed in a rough trimming stage 14 at a pressure between 5 bar–100 bar and preferably between 20 bar–40 bar. The rough trimming stage is achieved at low pressure by the combined action of the trimming device 6 and the punch 7. Under increased pressure, blank 1 is trimmed in a fine trim 15 by the trimming device 9 when the pressure reaches between 200 bar–900 bar and preferably between 400 bar–500 bar. Similarly, a development of the trimming devices 6 and 9, the piercing device (9*a*) is shaped, for example, as a third recess in the surface of the forming tool 5. The piercing device (9*a*) cuts out an area from blank 1 under the application of high pressure and creates an opening in the blank 1. After the required pressure, in the range of 200 bar–1,500 bar and preferably between 400 bar–1,200 bar, has been applied for the required time pressure is released. The press is opened. The finished, shaped, substantially flat article 10 is removed from the press. Excess material, the rough trimmed edges 12 and fine trimmed edges 11 of blank 1, and any material cut out so as to form an opening in blank 1, are removed.

What is claimed is:

1. A device for high pressure shaping of a flat article from a blank comprising:

a high pressure press having a membrane and a one-sided forming tool, the membrane being laterally spaced from the one-sided forming tool and the blank being held between the membrane and the one-sided forming tool by at least two clamps, the two clamps being movable away from each other to stretch the blank, the membrane pressing the blank against the one-sided forming tool when pressure is applied to the membrane.

2. The device according to claim 1, wherein said one-sided forming tool is provided with more than two clamps to hold the blank, the clamps being moveable relative to each other to stretch the blank along more than one axis.

3. The device according to claim 1, further comprising a trimming device having a punch extending between the membrane and the blank, the punch having a first surface area exposed to the membrane and a second surface area exposed to the blank, the first surface area being greater than the second surface area such that the punch acts as a force intensifier when pressure is applied to the membrane.

4. The device according to claim 1, further comprising a first trimming device and a second trimming device coupled to the one-sided forming tool.

5. A method for high pressure shaping of a flat article from a blank, including the steps of:

arranging said blank between at least two clamps;

stretching said blank by means of the at least two clamps to a pre-specified degree to attain work hardening due to plastic deformation; and applying pressure subsequently to said blank by means of a membrane and forcing said blank against a one-sided forming tool after the stretching has begun.

6. A method according to claim 5, including the steps of;

trimming at a first low pressure said blank with a second trimming device in co-operation with a punch thus separating the remainder of said blank from the at least two clamps; and trimming at an increased and second pressure which second pressure is a higher pressure than the first pressure said blank to a finished shape with a first trimming device.

7. A method according to claim 6, including the steps of;

increasing the pressure applied by said membrane to a third pressure that is higher than the second pressure;

maintaining the third pressure for a required time;

releasing the third pressure; and removing a shaped article.

8. A method according to claim 6, wherein the first pressure is between 5 bar and 100 bar and preferably between 20 bar and 40 bar.

9. A method according to claim 6, wherein the second pressure is between 200 bar and 900 bar and preferably between 400 bar and 500 bar.

10. A method according to claim 7, wherein the third pressure is between 200 bar and 1,500 bar and preferably between 400 bar and 1,200 bar.

11. A method according to claim 5, wherein said blank is held between more than the at least two clamps and said blank is stretched to a pre-specified degree in more than one axis.

12. A method according to claim 5, including the steps of pressing said blank with said membrane and cutting out an enclosed area shaped as an opening in said blank by means of a piercing device.

13. A method according to claim 12, wherein said blank is stretched by means of the at least two clamps trimmed by means of the first trimming device and the second trimming device and pierced by the piercing device and shaped against said one-sided forming tool in one single and continuous press cycle.

14. A method according to claim 5, including the step of arranging said blank between said at least two clamps in said high pressure press such that the microstructure of the metallic material is arranged in a preferred orientation with respect to one or more axes along which the blank is stretched.

15. The method according to claim 5 including the step of treating at least one surface of the blank with a surface treatment prior to inserting the blank into the high pressure press.

* * * * *

UNITED STATES PATENT AND TRADEMARK OFFICE

CERTIFICATE OF CORRECTION

PATENT NO. : 6,178,796 B1
DATED : January 30, 2001
INVENTOR(S) : Keijo Hellgren

It is certified that error appears in the above-identified patent and that said Letters Patent is hereby corrected as shown below:

Claims,
Claim 6, column 7,
Line 4, "steps of ;" should read -- steps of : --.
Line 11, "9 "pressure which" should read -- pressure, which --.
Line 11, "pressure said blank" should read -- pressure, said blank --.

Claim 7, column 7,
Line 13, "steps of;" should read -- steps of : --.

Claim 13, column 8,
Line 11, "two clamps trimmed by" should read -- two clamps, trimmed by --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,178,796 B1
DATED : January 30, 2001
INVENTOR(S) : Keijo Hellgren

It is certified that error appears in the above-identified patent and that said Letters Patent is hereby corrected as shown below:

Claims,
Claim 6, column 7,
Line 4, “steps of ;” should read -- steps of : --.
Line 9, “pressure which” should read -- pressure, which --.
Line 11, “pressure said blank” should read -- pressure, said blank --.

Claim 7, column 7,
Line 13, “steps of;” should read -- steps of : --.

Claim 13, column 8,
Line 11, “two clamps trimmed by” should read -- two clamps, trimmed by --.

This certificate supersedes Certificate of Correction issued October 16, 2001.

Signed and Sealed this

Seventeenth Day of September, 2002

*Attest:*

*Attesting Officer*

JAMES E. ROGAN
*Director of the United States Patent and Trademark Office*